US008257545B2

(12) United States Patent
Loyack et al.

(10) Patent No.: US 8,257,545 B2
(45) Date of Patent: Sep. 4, 2012

(54) CHEMICAL MECHANICAL POLISHING PAD WITH LIGHT STABLE POLYMERIC ENDPOINT DETECTION WINDOW AND METHOD OF POLISHING THEREWITH

(75) Inventors: Adam Loyack, Philadelphia, PA (US); Alan Nakatani, Lansdale, PA (US); Mary Jo Kulp, Newark, DE (US); David G. Kelly, Ambler, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 90 days.

(21) Appl. No.: 12/893,656

(22) Filed: Sep. 29, 2010

(65) Prior Publication Data

US 2012/0077418 A1 Mar. 29, 2012

(51) Int. Cl.
*B24D 11/00* (2006.01)
*B24B 49/12* (2006.01)

(52) U.S. Cl. ..... 156/345.13; 156/345.24; 451/6; 451/527

(58) Field of Classification Search ..... 156/345.12, 156/345.13, 345.24; 451/6, 527
See application file for complete search history.

(56) References Cited

U.S. PATENT DOCUMENTS

| | | | |
|---|---|---|---|
| 5,605,760 | A | 2/1997 | Roberts |
| 6,106,662 | A | 8/2000 | Bibby, Jr. et al. |
| 6,387,312 | B1 | 5/2002 | Roberts et al. |
| 6,607,422 | B1 | 8/2003 | Swedek et al. |
| 6,641,470 | B1 | 11/2003 | Zhao et al. |
| 6,685,537 | B1 | 2/2004 | Fruitman et al. |
| 6,753,972 | B1 | 6/2004 | Hirose et al. |
| 6,984,163 | B2 | 1/2006 | Roberts |
| 7,147,923 | B2 | 12/2006 | Roberts et al. |
| 7,198,544 | B2 | 4/2007 | Wiswesser |
| 2006/0276109 | A1 | 12/2006 | Roy et al. |

OTHER PUBLICATIONS

Copending U.S. Appl. No. 12/657,202, filed Jan. 15, 2010.

*Primary Examiner* — Sylvia R. MacArthur
(74) *Attorney, Agent, or Firm* — Thomas S. Deibert

(57) ABSTRACT

A chemical mechanical polishing pad is provided, comprising: a polishing layer having a polishing surface; and, a light stable polymeric endpoint detection window, comprising: a polyurethane reaction product of an aromatic polyamine containing amine moieties and an isocyanate terminated prepolymer polyol containing unreacted —NCO moieties; and, a light stabilizer component comprising at least one of a UV absorber and a hindered amine light stabilizer; wherein the aromatic polyamine and the isocyanate terminated prepolymer polyol are provided at an amine moiety to unreacted —NCO moiety stoichiometric ratio of <95%; wherein the light stable polymeric endpoint detection window exhibits a time dependent strain of ≦0.02% when measured with a constant axial tensile load of 1 kPa at a constant temperature of 60° C. at 100 minutes and an optical double pass transmission of ≧15% at a wavelength of 380 nm for a window thickness of 1.3 mm; and, wherein the polishing surface is adapted for polishing a substrate selected from a magnetic substrate, an optical substrate and a semiconductor substrate. Also provided is a method of polishing a substrate (preferably a semiconductor wafer) using the chemical mechanical polishing pad provided.

10 Claims, 1 Drawing Sheet

CHEMICAL MECHANICAL POLISHING PAD WITH LIGHT STABLE POLYMERIC ENDPOINT DETECTION WINDOW AND METHOD OF POLISHING THEREWITH

The present invention relates generally to the field of chemical mechanical polishing. In particular, the present invention is directed to a chemical mechanical polishing pad with a light stable polymeric endpoint detection window. The present invention is also directed to a method of chemical mechanical polishing of a substrate using a chemical mechanical polishing pad with a light stable polymeric endpoint detection window.

In the fabrication of integrated circuits and other electronic devices, multiple layers of conducting, semiconducting and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes nonplanar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

Chemical mechanical planarization, or chemical mechanical polishing (CMP), is a common technique used to planarize substrates, such as semiconductor wafers. In conventional CMP, a wafer is mounted on a carrier assembly and positioned in contact with a polishing pad in a CMP apparatus. The carrier assembly provides a controllable pressure to the wafer, pressing it against the polishing pad. The pad is moved (e.g., rotated) relative to the wafer by an external driving force. Simultaneously therewith, a polishing medium (e.g., slurry) is provided between the wafer and the polishing pad. Thus, the wafer surface is polished and made planar by the chemical and mechanical action of the pad surface and the polishing medium.

One challenge presented with chemical mechanical polishing is determining when the substrate has been polished to the desired extent. In situ methods for determining polishing endpoints have been developed. The in situ optical endpointing techniques can be divided into two basic categories: (1) monitoring the reflected optical signal at a single wavelength or (2) monitoring the reflected optical signal from multiple wavelengths. Typical wavelengths used for optical endpointing include those in the visible spectrum (e.g., 400 to 700 nm), the ultraviolet spectrum (315 to 400 nm), and the infrared spectrum (e.g., 700 to 1000 nm). In U.S. Pat. No. 5,433,651, Lustig et al disclosed a polymeric endpoint detection method using a single wavelength in which light from a laser source is transmitted on a wafer surface and the reflected signal is monitored. As the composition at the wafer surface changes from one metal to another, the reflectivity changes. This change in reflectivity is then used to detect the polishing endpoint. In U.S. Pat. No. 6,106,662, Bibby et al disclosed using a spectrometer to acquire an intensity spectrum of reflected light in the visible range of the optical spectrum. In metal CMP applications, Bibby et al. teach using the whole spectrum to detect the polishing endpoint.

To accommodate these optical endpointing techniques, chemical mechanical polishing pads have been developed having windows. For example, in U.S. Pat. No. 5,605,760, Roberts discloses a polishing pad wherein at least a portion of the pad is transparent to laser light over a range of wavelengths. In some of the disclosed embodiments, Roberts teaches a polishing pad that includes a transparent window piece in an otherwise opaque pad. The window piece may be a rod or plug of transparent polymer in a molded polishing pad. The rod or plug may be insert molded within the polishing pad (i.e., an "integral window"), or may be installed into a cut out in the polishing pad after the molding operation (i.e., a "plug in place window").

Aliphatic isocyanate based polyurethane materials, such as those described in U.S. Pat. No. 6,984,163 provided improved light transmission over a broad light spectrum. Unfortunately, these aliphatic polyurethane windows tend to lack the requisite durability required for demanding polishing applications.

Conventional polymer based endpoint detection windows often exhibit undesirable degradation upon exposure to light having a wavelength of 330 to 425 nm. This is particularly true for polymeric endpoint detection windows derived from aromatic polyamines, which tend to decompose or yellow upon exposure to light in the ultraviolet spectrum. Historically, filters have sometimes been used in the path of the light used for endpoint detection purposes to attenuate light having such wavelengths before exposure to the endpoint detection window. Increasingly, however, there is pressure to utilize light with shorter wavelengths for endpoint detection purposes in semiconductor polishing applications to facilitate thinner material layers and smaller device sizes.

Accordingly, what is needed is a light stable polymeric endpoint detection window that enables the use of light having a wavelength <400 nm for substrate polishing endpoint detection purposes, wherein the light stable polymeric endpoint detection windows are resistant to degradation upon exposure to that light, do not exhibit undesirable window deformation and has the required durability for demanding polishing applications.

The present invention provides a chemical mechanical polishing pad comprising: a polishing layer having a polishing surface; and, a light stable polymeric endpoint detection window, comprising: a polyurethane reaction product of an aromatic polyamine containing amine moieties and an isocyanate terminated prepolymer polyol containing unreacted —NCO moieties; and, a light stabilizer component comprising at least one of a UV absorber and a hindered amine light stabilizer; wherein the aromatic polyamine and the isocyanate terminated prepolymer polyol are provided at an amine moiety to unreacted —NCO moiety stoichiometric ratio of <95%; wherein the light stable polymeric endpoint detection window exhibits a time dependent strain of ≦0.02% when measured with a constant axial tensile load of 1 kPa at a constant temperature of 60° C. at 100 minutes and an optical double pass transmission of ≧15% at a wavelength of 380 nm for a window thickness of 1.3 mm; and, wherein the polishing surface is adapted for polishing a substrate selected from a magnetic substrate, an optical substrate and a semiconductor substrate.

The present invention provides a method of chemical mechanical polishing of a substrate comprising: providing a chemical mechanical polishing apparatus having a platen, a light source and a photosensor; providing at least one substrate selected from a magnetic substrate, an optical substrate and a semiconductor substrate; providing a chemical mechanical polishing pad according to the present invention;

installing onto the platen the chemical mechanical polishing pad; optionally providing a polishing medium at an interface between the polishing surface and the substrate; creating dynamic contact between the polishing surface and the substrate, wherein at least some material is removed from the substrate; and, determining a polishing endpoint by transmitting light from the light source through the light stable polymeric endpoint detection window and analyzing the light reflected off the surface of the substrate back through the light stable polymeric endpoint detection window incident upon the photosensor.

DETAILED DESCRIPTION

Figure 1:
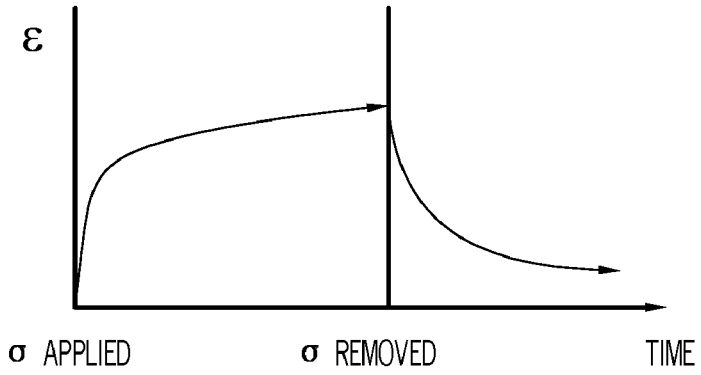
FIG. 1 is a schematic plot of a typical time dependent strain response for a non-cross linked viscoelastic polymer material.

The chemical mechanical polishing pad of the present invention is useful for polishing a substrate selected from a magnetic substrate, an optical substrate and a semiconductor substrate. In particular, the chemical mechanical polishing pad of the present invention is useful for polishing semiconductor wafers—especially for advanced applications such as copper-barrier or shallow trench isolation (STI) applications that utilize endpoint detection.

The term "polishing medium" as used herein and in the appended claims encompasses particle containing polishing solutions and non-particle-containing polishing solutions, such as abrasive free and reactive liquid polishing solutions.

The term "poly(urethane)" as used herein and in the appended claims encompasses (a) polyurethanes formed from the reaction of (i) isocyanates and (ii) polyols (including diols); and, (b) poly(urethane) formed from the reaction of (i) isocyanates with (ii) polyols (including diols) and (iii) water, amines (including diamines and polyamines) or a combination of water and amines (including diamines and polyamines).

The term "double pass transmission" or "DPT" as used herein and in the appended claims in reference to a light stable polymeric endpoint detection window is determined using the following equation:

$$DPT = \frac{IW_{Si} - IW_D}{IA_{Si} - IA_D}$$

wherein $IW_{Si}$, $IW_D$, $IA_{Si}$, and $IA_D$ are measured using a Verity SP2006 Spectral Interferometer including a SD1024F spectrograph, a xenon flash lamp and a 3 mm fiber optic cable by placing a light emitting surface of the 3 mm fiber optic cable against (and normal to) a first face of the light stable polymeric endpoint detection window at a point of origin, directing light through the thickness of the window and measuring at the point of origin the intensity of 380 nm light reflected back through the thickness of the window from a surface positioned against a second face of the light stable polymeric endpoint detection window substantially parallel to the first face; wherein $IW_{Si}$ is a measurement of the intensity of 380 nm light that passes through the window from the point of origin and reflects off the surface of a silicon blanket wafer placed against a second face of the window back through the window to the point of origin; wherein $IW_D$ is a measurement of the intensity of 380 nm light that passes from the point of origin through the window and reflects off the surface of a black body and back through the window to the point of origin; wherein $IA_{Si}$ is a measurement of the intensity of 380 nm light that passes from the point of origin through a thickness of air equivalent to the thickness of the light stable polymeric endpoint detection window, reflects off the surface of a silicon blanket wafer placed normal to the light emitting surface of the 3 mm fiber optic cable and reflects back through the thickness of air to the point of origin; and, wherein $IA_D$ is a measurement of the intensity of 380 nm light reflected off a black body at the light emitting surface of the 3 mm fiber optic cable.

The term "initial double pass transmission" or "$DPT_I$" as used herein and in the appended claims is the DPT exhibited by a light stable polymeric endpoint detection window for light having a wavelength of 380 nm upon manufacture before exposure to high intensity ultraviolet light produced by a 100 W mercury vapor short arc lamp through a 5 mm diameter fiber optic wand calibrated to provide an intensity of 500 $mW/cm^2$.

The term "exposed double pass transmission" or "$DPT_E$" as used herein and in the appended claims is the DPT exhibited by a light stable polymeric endpoint detection window for light having a wavelength of 380 nm following exposure to high intensity ultraviolet light produced by a 100 w mercury vapor short arc lamp through a 5 mm diameter fiber optic wand calibrated to provide an intensity of 500 $mW/cm^2$.

The term "accelerated light stability" or "ALS" as used herein and in the appended claims is determined using the following equation:

$$ALS = \frac{DPT_E}{DPT_I}$$

for light at a wavelength of 380 nm.

The term "clear window" as used herein and in the appended claims in reference to the light stable polymeric endpoint detection window means that the light stable polymeric endpoint detection window exhibits an initial double pass transmission of $\geqq 15\%$ for light at a wavelength of 380 nm.

The term "creep resistant window" as used herein and in the appended claims in reference to the light stable polymeric endpoint detection window means that the light stable polymeric endpoint detection window exhibits a time dependent strain of $\leqq 0.02\%$, including negative strains, when measured with a constant axial tensile load of 1 kPa at a constant temperature of 60° C. at 100 minutes.

The terms "creep response" and "time dependent strain" are used interchangeably herein and in the appended claims in reference to the light stable polymeric endpoint detection window and mean the time dependent strain measured with a constant axial tensile load of 1 kPa at a constant temperature of 60° C.

The chemical mechanical polishing pad of the present invention contains a light stable polymeric endpoint detection window that allows for optical endpoint detection for substrate polishing operations. Light stable polymeric endpoint detection windows preferably exhibit several process criteria, including acceptable optical transmission (i.e., they are clear windows); low defect introduction to the surface being polished with the chemical mechanical polishing pad; and, the ability to withstand the rigors of the polishing process, including exposure to light having a wavelength of 330 to 425 nm without significant optical degradation (i.e., they exhibit an ALS of ≧0.65 for light having a wavelength of 380 nm).

The light stable polymeric endpoint detection window in the chemical mechanical polishing pad of the present invention, comprises: a polyurethane reaction product of an aromatic polyamine containing amine moieties and an isocyanate terminated prepolymer polyol containing unreacted —NCO moieties; and, a light stabilizer component comprising at least one of a UV absorber and a hindered amine light stabilizer.

The light stable polymeric endpoint detection window in the chemical mechanical polishing pad of the present invention is formulated to exhibit an accelerated light stability of ≧0.65 (preferably ≧0.70, more preferably ≧0.90); and, an initial double pass transmission of ≧10% (preferably ≧10% to 100%, more preferably ≧15%, most preferably ≧15% to 75%) for light with a wavelength of 380 nm. Preferably, the light stable polymeric endpoint detection window exhibits an accelerated light stability of ≧0.90; and an initial double pass transmission of ≧15% (most preferably ≧15% to 75% for light with a wavelength of 380 nm.

Preferably, the light stable polymeric endpoint detection window in the chemical mechanical polishing pad of the present invention is a polyurethane reaction product of an aromatic polyamine and an isocyanate terminated prepolymer polyol, wherein the aromatic polyamine and the isocyanate terminated prepolymer polyol are provided at an amine moiety to unreacted —NCO moiety stoichiometric ratio of <95%. This stoichiometry may be achieved either directly, by providing the stoichiometric levels of the raw materials, or indirectly by reacting some of the —NCO with water either purposely or by exposure to adventitious moisture.

Preferably, the light stable polymeric endpoint detection window in the chemical mechanical polishing pad produced using an amine moiety to unreacted —NCO moiety stoichiometic ratio of <95% is formulated to be a creep resistant window. More preferably, the creep resistant window is formulated to have an amine moiety to unreacted —NCO moiety stoichiometric ratio of ≦90% (most preferably 75 to 90%); to exhibit a time dependent strain of ≦0.02% when measured with a constant axial tensile load of 1 kPa at a constant temperature of 60° C. at 100 minutes; a Shore D hardness of 45 to 80 (preferably a Shore D hardness of 50 to 80, most preferably a Shore D hardness of 55 to 75) as measured according to ASTM D2240-05; and, an optical double pass transmission of ≧15% at a wavelength of 380 nm for a window thickness of 1.3 mm. The stoichiometric ratios of <95% provide an excess of isocyanate groups. This excess of isocyanate groups promotes cross linking in the light stable polymeric endpoint detection window. Cross linking is believed to increase the dimensional stability of the light stable polymeric endpoint detection window, while maintaining adequate transmission of light at wavelengths between 300 nm and 500 nm.

It is believed that a time dependent strain of ≦0.02 when measured with a constant axial tensile load of 1 kPa at a constant temperature of 60° C. at 100 minutes enables a light stable polymeric endpoint detection window to withstand the rigors of polishing without excessive deformation. Optionally, metastable polyurethanes serve to further increase the creep resistance of the polymer endpoint detection window. For purposes of this specification, "metastable polyurethanes" are polyurethanes that contract in an inelastic fashion with temperature, stress or a combination of temperature and stress. For example, it is possible for incomplete curing of the light stable polymeric endpoint detection window or unrelieved stress associated with its fabrication to result in a contraction in the physical dimensions of the window upon exposure to the stress and elevated temperatures associated with polishing of a substrate (particularly a semiconductor wafer). A light stable polymeric endpoint detection window comprising a metastable polyurethane can exhibit a negative time dependent strain when measured with a constant axial tensile load of 1 kPa at a constant temperature of 60° C. at 100 minutes. This negative time dependent strain imparts the light stable polymeric endpoint detection window with an excellent creep resistance.

Aromatic polyamines suitable for use in the preparation of the polymeric endpoint detection window of the present invention include, for example: diethyl toluene diamine ("DETDA"); 3,5-dimethylthio-2,4-toluenediamine and isomers thereof; 3,5-diethyltoluene-2,4-diamine and isomers thereof (e.g., 3,5-diethyltoluene-2,6-diamine); 4,4'-bis-(sec-butylamino)-diphenylmethane; 1,4-bis-(sec-butylamino)-benzene; 4,4'-methylene-bis-(2-chloroaniline) ("MOCA"); 4,4'-methylene-bis-(3-chloro-2,6-diethylaniline) ("MCDEA"); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2,6-diethylaniline) ("MDEA"); 4,4'-methylene-bis-(2,3-dichloroaniline) ("MDCA"); 4,4'-diamino-3,3'-diethyl-5,5'-dimethyl diphenylmethane; 2,2',3,3'-tetrachloro diamino diphenylmethane; trimethylene glycol di-p-aminobenzoate; and mixtures thereof. Preferably, the aromatic polyamine includes DETDA. Most preferably, the aromatic polyamine is DETDA.

Isocyanate terminated prepolymer polyols containing unreacted —NCO moieties suitable for use in the preparation of the light stable polymeric endpoint detection window of the present invention are produced through the reaction of an aliphatic or cycloaliphatic diisocyanate and a polyol in a prepolymer mixture. The isocyanate terminated prepolymer polyol can exhibit an average of >2 unreacted —NCO moieties per molecule to promote cross linking in the light stable polymeric endpoint detection window.

Aliphatic polyisocyanates suitable for use in producing the isocyanate terminated prepolymer polyol containing unreacted —NCO moieties include, for example: methylene-bis (4-cyclohexylisocyanate) ("$H_{12}$MDI"); cyclohexyl diisocyanate; isophorone diisocyanate ("IPDI"); hexamethylene diisocyanate ("HDI"); propylene-1,2-diisocyanate; tetramethylene-1,4-diisocyanate; 1,6-hexamethylene-diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of hexamethylene diisocyanate; triisocyanate of 2,4,4-trimethyl-1,6-hexane diisocyanate; uretdione of hexamethylene diisocyanate; ethylene diisocyanate; 2,2,4-trimethylhexamethylene diisocyanate; 2,4,4-trimethylhexamethylene diisocyanate; dicyclohexylmethane diisocyanate; and mixtures thereof. Preferably, the aliphatic polyisocyanate has less than 14 wt % unreacted isocyanate groups.

Polyols suitable for use in producing the isocyanate terminated prepolymer polyol containing unreacted —NCO moieties include, for example: polyether polyols, hydroxy-terminated polybutadiene (including partially/fully hydrogenated derivatives), polyester polyols, polycaprolactone polyols, and polycarbonate polyols. The hydrocarbon chain in the polyols can have saturated or unsaturated bonds and substituted or unsubstituted aromatic and cyclic groups. Preferred polyols include polytetramethylene ether glycol ("PT- MEG"); polyethylene propylene glycol; polyoxypropylene glycol; polyethylene adipate glycol; polybutylene adipate glycol; polyethylene propylene adipate glycol; o-phthalate-1,6-hexanediol; poly(hexamethylene adipate) glycol; 1,6-hexanediol-initiated polycaprolactone; diethylene glycol initiated polycaprolactone; trimethylol propane initiated polycaprolactone; neopentyl glycol initiated polycaprolactone; 1,4-butanediol-initiated polycaprolactone; PTMEG-initiated polycaprolactone; polyphthalate carbonate; poly (hexamethylene carbonate) glycol; 1,4-butanediol; diethylene glycol; tripropylene glycol and mixtures thereof. The most preferred polyol is PTMEG.

Optional chain extenders suitable for use in producing the light stable polymeric endpoint detection window of the present invention, include, for example: hydroxy terminated diols, triols and tetrols. Preferred chain extenders include ethylene glycol; diethylene glycol; polyethylene glycol; propylene glycol; polypropylene glycol; polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(beta-hydroxyethyl)ether; hydroquinone-di-(beta-hydroxyethyl) ether; and mixtures thereof. More preferred chain extenders include 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; and mixtures thereof. The optional chain extenders can include saturated, unsaturated, aromatic and cyclic groups. Additionally, the optional chain extenders can include a halogen. Preferably the chain extenders has at least three reactive moieties per molecule, wherein the reactive moieties are selected from —OH and —$NH_2$.

Cross linking of the polyurethane reaction product can occur through multiple mechanisms. One such mechanism is to use an excess of isocyanate groups in the prepolymer in relation to the isocyanate reactive moieties present in the aromatic polyamine (i.e., —OH and —$NH_2$) and any optional chain extender used to produce the polyurethane reaction product. Another mechanism is to use a prepolymer containing greater than two unreacted aliphatic isocyanate groups. The curing reaction of prepolymers containing greater than two unreacted aliphatic isocyanate groups results in a beneficial structure that is more likely to be cross linked. Another mechanism is to use a cross linking polyol with greater than two isocyanate reactive moieties (i.e., —OH and —$NH_2$); a crosslinking polyamine with greater than two isocyanate reactive moieties (i.e., —OH and —$NH_2$); or a combination thereof. Optionally, the polyurethane reaction product is selected to exhibit increased cross linking to impart creep resistance to the light stable polymeric endpoint detection window.

Light stabilizer component suitable for use in the preparation of the light stable polymeric endpoint detection window of the present invention include, for example light stabilizer compounds that do not strongly attenuate the transmission of light having a wavelength between 370 nm and 700 nm. Light stabilizer components include hindered amine compounds and UV stabilizer compounds. Preferred light stabilizer compounds include hindered amine compounds, tris-aryl triazine compounds, hydroxy phenyl triazines, benzotriazole compounds, benzophenone compounds, benzoxazinone compounds, cyanoacrylate compounds, amide functional compounds and mixtures thereof. More preferred light stabilizer compounds include hindered amine compounds, hydroxy phenyl triazine compounds, benzotriazole compounds, benzophenone compounds and mixtures thereof. Most preferred light stabilizer compounds include a combination of a hindered amine compound and at least one of a benzophenone compound, a benzotriazole compound and a hydroxy phenyl triazine compound.

The light stable polymeric endpoint detection window used in the chemical mechanical polishing pad of the present invention preferably contains 0.1 to 5 wt % light stabilizer component. More preferably, the light stable polymeric endpoint detection window contains 0.2 to 3 wt % (still more preferably 0.25 to 2 wt %, most preferably 0.3 to 1.5 wt %) light stabilizer component.

The light stable polymeric endpoint detection window used in the chemical mechanical polishing pad of the present invention is selected from a plug-in-place window and an integral window.

The polishing layer in the chemical mechanical polishing pad of the present invention is a polymeric material comprising a polymer selected from polycarbonates, polysulfones, nylons, polyethers, polyesters, polystyrenes, acrylic polymers, polymethyl methacrylates, polyvinylchlorides, polyvinylfluorides, polyethylenes, polypropylenes, polybutadienes, polyethylene imines, polyurethanes, polyether sulfones, polyamides, polyether imides, polyketones, epoxies, silicones, EPDM, and combinations thereof. Preferably, the polishing layer comprises a polyurethane. One of ordinary skill in the art will understands to select a polishing layer having a thickness suitable for use in a chemical mechanical polishing pad for a given polishing operation. Preferably, the polishing layer exhibits an average thickness of 20 to 150 mils (more preferably 30 to 125 mils; most preferably 40 to 120 mils).

The chemical mechanical polishing pad of the present invention optionally further comprises a base layer interfaced with the polishing layer. The polishing layer can optionally be attached to the base layer using an adhesive. The adhesive can be selected from pressure sensitive adhesives, hot melt adhesives, contact adhesives and combinations thereof. Preferably, the adhesive is a hot melt adhesive or a pressure sensitive adhesive. More preferably, the adhesive is a hot melt adhesive.

The chemical mechanical polishing pad of the present invention optionally further comprises a base layer and at least one additional layer interfaced with and interposed between the polishing layer and the base layer. The various layers can optionally be attached together using an adhesive. The adhesive can be selected from pressure sensitive adhesives, hot melt adhesives, contact adhesives and combinations thereof. Preferably, the adhesive is a hot melt adhesive or a pressure sensitive adhesive. More preferably, the adhesive is a hot melt adhesive.

The chemical mechanical polishing pad of the present invention is preferably adapted to be interfaced with a platen of a polishing machine. The chemical mechanical polishing pad of the present invention is optionally adapted to be affixed to the platen using at least one of a pressure sensitive adhesive and vacuum.

The polishing surface of the polishing layer of the chemical mechanical polishing pad of the present invention optionally exhibits at least one of macrotexture and microtexture to facilitate polishing the substrate. Preferably, the polishing surface exhibits macrotexture, wherein the macrotexture is designed to do at least one of (i) alleviate at least one of hydroplaning; (ii) influence polishing medium flow; (iii) modify the stiffness of the polishing layer; (iv) reduce edge effects; and, (v) facilitate the transfer of polishing debris away from the area between the polishing surface and the substrate.

The polishing surface of the polishing layer of the chemical mechanical polishing pad of the present invention optionally exhibits macrotexture selected from at least one of perforations and grooves. Preferably, the perforations can extend from the polishing surface part way or all of the way through the thickness of the polishing layer. Preferably, the grooves are arranged on the polishing surface such that upon rotation of the pad during polishing, at least one groove sweeps over the substrate. Preferably, the grooves are selected from curved grooves, linear grooves and combinations thereof. The grooves exhibit a depth of ≧10 mils; preferably 10 to 150 mils. Preferably, the grooves form a groove pattern that comprises at least two grooves having a combination of a depth selected from ≧10 mils, ≧15 mils and 15 to 150 mils; a width selected from ≧10 mils and 10 to 100 mils; and a pitch selected from ≧30 mils, ≧50 mils, 50 to 200 mils, 70 to 200 mils, and 90 to 200 mils.

The method of the present invention for chemical mechanical polishing of a substrate comprises: providing a chemical mechanical polishing apparatus having a platen, a light source and a photosensor (preferably a multisensor spectrograph); providing at least one substrate selected from a magnetic substrate, an optical substrate and a semiconductor substrate (preferably a semiconductor substrate; most preferably a semiconductor wafer); providing a chemical mechanical polishing pad of the present invention; installing onto the platen the chemical mechanical polishing pad; optionally providing a polishing medium at an interface between the polishing surface and the substrate; creating dynamic contact between the polishing surface and the substrate, wherein at least some material is removed from the substrate; and, determining a polishing endpoint by transmitting light from the light source through the light stable polymeric endpoint detection window and analyzing the light reflected off the surface of the substrate back through the light stable polymeric endpoint detection window incident upon the photosensor. Preferably, the polishing endpoint is determined based on an analysis of a wavelength of light reflected off the surface of the substrate and transmitted through the light stable polymeric endpoint detection window, wherein the wavelength of light has a wavelength of >370 nm to 400 nm. More preferably, the polishing endpoint is determined based on an analysis of multiple wavelengths of light reflected off the surface of the substrate and transmitted through the light stable polymeric endpoint detection window, wherein one of the wavelengths analyzed has a wavelength of >370 nm to 400 nm. Preferably, the light stable polymeric endpoint detection window in the chemical mechanical polishing pad used in the method of the present invention is a creep resistant window.

Some embodiments of the present invention will now be described in detail in the following Examples.

Comparative Example C and Examples 1-10

Preparation of Endpoint Detection Windows

Endpoint detection window blocks were prepared for integration into chemical mechanical polishing layers as integral windows as follows. The stabilizer package ("SP") noted in TABLE 1 was combined with an aromatic polyamine ("AP") (i.e., diethyl toluene diamine "DETDA") in the amount noted in TABLE 1. The combined stabilizer/aromatic polyamine was then combined with an isocyanate terminated prepolymer polyol ("ITPP")(i.e., LW570 available from Chemtura) at stoichiometric ratio of —$NH_2$ to —NCO of 80%. The resulting material was then introduced into a mold. The contents of the mold were then cured in an oven for eighteen (18) hours. The set point temperature for the oven was set at 93° C. for the first twenty (20) minutes; 104° C. for the following fifteen (15) hours and forty (40) minutes; and then dropped to 21° C. for the final two (2) hours. The window blocks were then cut into plugs to facilitate incorporation into polishing pad cakes by conventional means.

TABLE 1

| Ex. | (SP) | SP added (in pph[¥]) |
|---|---|---|
| C | none (control) | 0 |
| 1 | Tinuvin ® 123 | 1 |
| 2 | Tinuvin ® 662 | 1 |
| 3 | Tinuvin ® 765 | 1 |
| 4 | Univul ® 3039 | 1 |
| 5 | Tinuvin ® PUR 866 | 1 |
| 6 | Univul ® 3039 [€] | 1 |
| 7 | Univul ® 3039 [€] | 0.8 |
| 8 | Univul ® 3039 | 0.3 |
| 9 | Tinuvin ® 123 + Univul ® 3039 | 0.5 + 0.5 |
| 10 | Tinuvin ® 765 + Univul ® 3039 | 0.5 + 0.5 |

[¥]pph means the parts of SP relative to 100 parts of (AP + ITPP);

[€]the noted Univul 3039 material was obtained from Aldrich, all other SP materials noted in TABLE 1 were obtained from BASF.

Example 11

Hardness

The hardness of a light stable polymeric endpoint detection window prepared according to Example 5 is measured according to ASTM D2240-05 and is determined to be 67 Shore D.

Example 12

Transmission Testing and Accelerated Light Stability

Transmission testing was performed using a Verity SP2006—Spectral Interferometer consisting of a SD1024F Spectrograph, a xenon flash lamp and a 3 mm fiber optic cable. Data analysis was performed using the SpectraView applications software version 4.40. The Verity SP2006 has a working range of 200 to 800 nm. The accelerated light stability ("ALS") data reported in TABLE 2 were derived from light transmission measurements (i.e., $IW_{Si}$, $IW_D$, $IA_{Si}$, and $IA_D$) made for light having a wavelength of 380 nm using a standard 2-pass arrangement. That is, light was transmitted through the samples, reflected off a silicon blanket wafer for $IW_{Si}$ and $IW_D$; or a black body for $IA_{Si}$ and $IA_D$), transmitted back through the sample to the detector, which measured the intensity of light incident thereon having a wavelength of 380 nm.

The transmission measurements used for the calculation of $DPT_I$ were determined for each sample by measuring $IW_{Si}$ and $IW_D$ before exposure to a high intensity ultraviolet light source. The transmission measurements used for the calculation of $DPT_E$ were determined for each sample by measuring $IW_{Si}$ and $IW_D$ after exposure to high intensity ultraviolet light produced by a 100 W mercury vapor short arc lamp through a 5 mm diameter fiber optic wand, wherein the wand intensity was calibrated to provide 500 mW/cm$^2$. In each case, the sample was placed on a sample exposure table and exposed to light from the 5 mm diameter fiber optic wand positioned 2.54 cm above the surface of the sample exposure table for a period of two (2) minutes. The ALS was then calculated for each sample from the following equation with the results provided in TABLE 2.

$$ALS = \frac{DPT_E}{DPT_I}$$

The transmission cut off wavelength ("$\lambda_{co}$") reported for the samples listed in TABLE 2 is the wavelength at and below which the calculated $DPT_I$ is zero. Note that the 1 was determined using samples that had not been exposed to the high intensity ultraviolet light source.

TABLE 2

| Ex. | $\lambda_{co}$ (in nm) | ALS $\lambda$ = 380 nm) |
|---|---|---|
| C | 330 | 0.66 |
| 1 | 330 | 0.73 |
| 2 | 330 | 0.66 |
| 3 | 330 | 0.65 |
| 4 | 370 | 0.93 |
| 5 | 360 | 0.93 |
| 6 | 370 | 0.94 |
| 7 | 370 | 0.82 |
| 8 | 370 | 0.79 |
| 9 | 370 | 0.89 |
| 10 | 370 | 0.84 |

Example 13

Creep Resistance

A tensile creep analysis was performed on a sample of a creep resistant, light stable polymeric endpoint detection window prepared according to the procedure described in Example 5 to measure the time dependent strain, $\in(t)$, of the sample when subjected to a constant applied stress, $\sigma_0$. The time dependent strain is a measure of the extent of deformation of a sample and is defined as follows:

$$\frac{\Delta L(t)}{L_0} \times 100\%.$$

The applied stress is defined as the applied force, F, divided by the cross sectional area of the test specimen. The tensile creep compliance, D(t), is defined as follows:

$$D(t) = \frac{g(t)}{\sigma_0}.$$

Creep compliance is typically reported on a log scale. Because the experimental strain value was negative and the log of a negative number cannot be defined, the strain value for the creep resistant, light stable polymeric endpoint detection window material is reported in lieu of creep compliance. Both values are synonymous under constant stress. Accordingly, the measured strain value of the creep resistant, light stable polymeric endpoint detection window material has technical significance.

The creep compliance is plotted as a function of time and a textbook example of the creep response (strain) of a viscoelastic polymer as a function of time is shown in FIG. 1. The stress, $\sigma$, is applied at t=0. The polymer initially deforms in an elastic fashion and continues to slowly stretch (creep) with time (left curve). When the stress is removed, the polymer recoils (right curve). A viscoelastic material does not fully retract, whereas a purely elastic material returns to its initial length.

Figure 2:
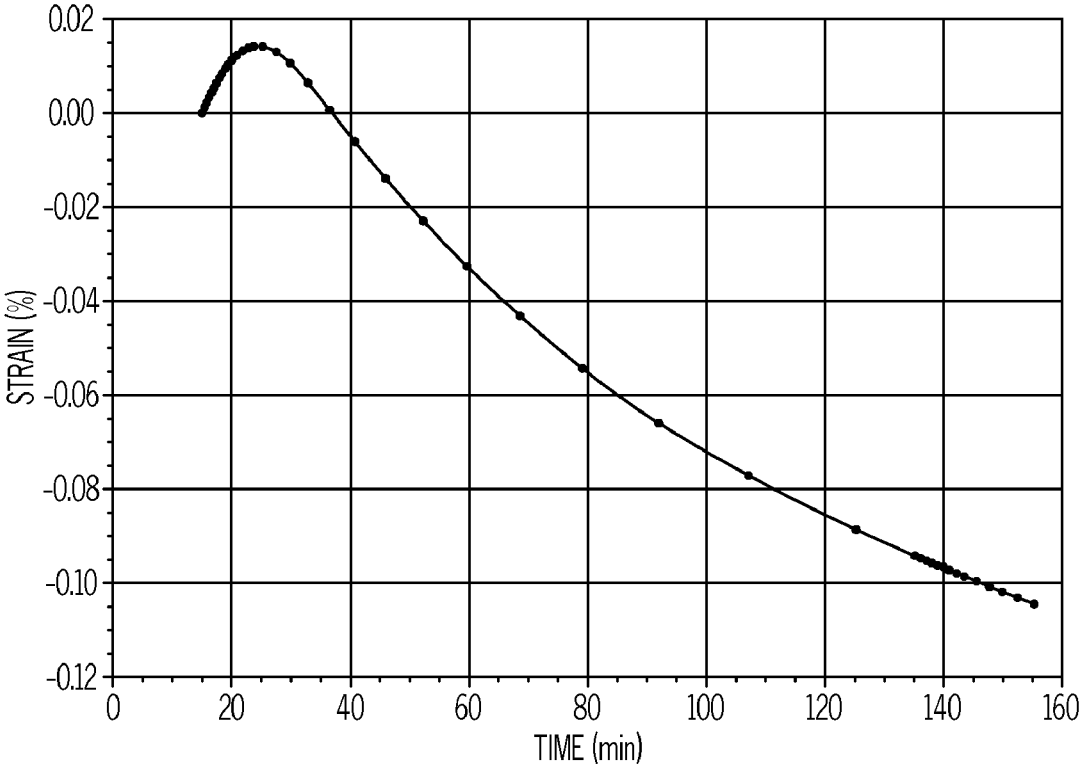
FIG. 2 is a plot of the time dependent strain response for an as-manufactured creep resistant polymeric endpoint detection window material.

The creep measurements were performed using a TA Instruments Q800 DMA using tensile clamp fixtures. All creep experiments were performed at 60° C. to simulate the polishing temperature. The test sample was allowed to equilibrate at the test temperature for 15 minutes before applying stress. The stress applied to the sample was 1 kPa. The dimensions of the test specimen were measured using a micrometer before testing. Nominal sample dimensions were 15 mm×5 mm×2 mm. The stress was applied to the sample for 120 minutes. After 120 minutes, the applied stress was removed and measurements were continued for another 30 minutes. The creep compliance and sample strain were recorded as a function of time. The creep resistant, light stable window material supplied for testing originated from manufactured integral window pads. FIG. 2 illustrates the negative time dependent strain response of the creep resistant, light stable polymeric endpoint detection window material in the as-manufactured state.

We claim:

1. A chemical mechanical polishing pad comprising:

a polishing layer having a polishing surface; and, a light stable polymeric endpoint detection window, comprising:

a polyurethane reaction product of an aromatic polyamine containing amine moieties and an isocyanate terminated prepolymer polyol containing unreacted —NCO moieties; and, a light stabilizer component comprising at least one of a UV absorber and a hindered amine light stabilizer;

wherein the aromatic polyamine and the isocyanate terminated prepolymer polyol are provided at an amine moiety to unreacted —NCO moiety stoichiometric ratio of <95%; wherein the light stable polymeric endpoint detection window exhibits a time dependent strain of ≦0.02% when measured with a constant axial tensile load of 1 kPa at a constant temperature of 60° C. at 100 minutes and an optical double pass transmission of ≧15% at a wavelength of 380 nm for a window thickness of 1.3 mm; and, wherein the polishing surface is adapted for polishing a substrate selected from a magnetic substrate, an optical substrate and a semiconductor substrate.

2. The chemical mechanical polishing pad of claim 1, wherein the light stable polymeric endpoint detection window contains 0.1 to 5 wt % light stabilizer component.

3. The chemical mechanical polishing pad of claim 2, wherein the light stable polymeric endpoint detection window exhibits an accelerated light stability measured at 380 nm of ≧0.65 upon exposure to light produced by a 100 W mercury vapor short-arc lamp through a 5 mm diameter fiber optic wand calibrated to provide an output intensity of 500 $mW/cm^2$.

4. The chemical mechanical polishing pad of claim 3, wherein the light stable polymeric endpoint detection window is metastable with a negative time dependent strain.

5. The chemical mechanical polishing pad of claim 2, wherein the light stable polymeric endpoint detection window exhibits an initial double pass transmission of ≧15% for light at 380 nm.

6. The chemical mechanical polishing pad of claim 1, wherein the isocyanate terminated prepolymer polyol comprises an average of >2 —NCO moieties per molecule.

7. The chemical mechanical polishing pad of claim 1, wherein the light stable polymeric endpoint detection window comprises a polyurethane reaction product of the aromatic polyamine, the isocyanate terminated prepolymer polyol and a chain extender; wherein the chain extender has at least three reactive moieties per molecule; and, wherein the chain extender is selected from a crosslinking polyol, a crosslinking polyamine, and combinations thereof.

8. The chemical mechanical polishing pad of claim 1, wherein the aromatic polyamine and the isocyanate terminated prepolymer polyol are provided at an amine moiety to unreacted —NCO moiety stoichiometric ratio of <90%; wherein the light stable polymeric endpoint detection window exhibits a negative time dependent strain when measured with a constant axial tensile load of 1 kPa at a constant temperature of 60° C. at 100 minutes, a Shore D hardness of 50 to 80 and an optical double pass transmission of ≧15% at a wavelength of 380 nm for a window thickness of 1.3 mm.

9. The chemical mechanical polishing pad of claim 1, wherein the light stable polymeric endpoint detection window is an integral window.

10. A method of chemical mechanical polishing of a substrate comprising:

providing a chemical mechanical polishing apparatus having a platen, a light source and a photosensor;

providing at least one substrate selected from a magnetic substrate, an optical substrate and a semiconductor substrate;

providing a chemical mechanical polishing pad according to any one of claims 1 to 9;

installing onto the platen the chemical mechanical polishing pad;

optionally providing a polishing medium at an interface between the polishing surface and the substrate;

creating dynamic contact between the polishing surface and the substrate, wherein at least some material is removed from the substrate; and, determining a polishing endpoint by transmitting light from the light source through the light stable polymeric endpoint detection window and analyzing the light reflected off the surface of the substrate back through the light stable polymeric endpoint detection window incident upon the photosensor.

* * * * *